United States Patent [19]

Barrash

[11] 4,420,137

[45] Dec. 13, 1983

[54] ADJUSTABLE FOLDING, SPRINGBACK SHELF BRACKET

[75] Inventor: Marshall J. Barrash, Atlanta, Ga.

[73] Assignee: The Coca-Cola Company, Atlanta, Ga.

[21] Appl. No.: 314,039

[22] Filed: Oct. 22, 1981

[51] Int. Cl.[3] ..... A47G 29/02

[52] U.S. Cl. ..... 248/240.4; 16/225

[58] Field of Search ..... 248/240.4, 293; 16/302, 16/225, 308; 108/116, 139, 135, 136

[56] References Cited

U.S. PATENT DOCUMENTS

| | | | |
|---|---|---|---|
| 251,591 | 12/1881 | Jaeger | 16/308 X |
| 1,058,920 | 4/1913 | Strom | 248/240.4 X |
| 1,347,116 | 7/1920 | Morgan | 248/240.4 |
| 2,905,424 | 9/1959 | Snow | 248/240.4 |
| 3,086,657 | 4/1963 | Myers et al. | 108/134 X |
| 3,364,885 | 1/1968 | Brothers | 108/136 X |
| 3,613,152 | 10/1971 | Spurlin | 16/302 |
| 4,131,971 | 1/1979 | Saarloos | 16/225 |

FOREIGN PATENT DOCUMENTS

| | | | |
|---|---|---|---|
| 1233292 | 1/1967 | Fed. Rep. of Germany | 16/308 |
| 2439807 | 8/1974 | Fed. Rep. of Germany | 16/225 |

*Primary Examiner*—William E. Lyddane
*Assistant Examiner*—Peter A. Aschenbrenner
*Attorney, Agent, or Firm*—Birch, Stewart, Kolasch & Birch

[57] ABSTRACT

A spring-biased shelf bracket which comprises a shelf support member which is adapted to operate between a folded closed position and an open position wherein a portion thereof extends away from its folded position. The bracket includes a back member and hinge means having a dimension which separates the shelf support member from the back member. A mounting flange adds rigidity to the shelf support member and provides the means for mounting the bracket to a surface. Channel means are provided at the peripheral portions of the shelf support member, the back member and the hinge means, and spring means are operatively associated with said channel means on at least one side of the shelf member and hinge means, whereby a shelf member supported by the bracket is held in its closed, folded position by the bias of the spring means and can be changed to its open, unfolded position by applying a load to the shelf support member against the bias of the spring means.

17 Claims, 3 Drawing Figures

ADJUSTABLE FOLDING, SPRINGBACK SHELF BRACKET

BACKGROUND AND SUMMARY OF THE INVENTION

The present invention relates to an adjustable, springback shelf bracket that will unfold from a substantially vertical position to a substantially horizontal position when the shelf is provided with a load, and will springback to a vertical position after the load has been removed from the shelf. More particularly, the present invention is directed to a spring-biased shelf bracket which enables the shelf to be located at a variety of vertical positions, to accommodate packages of various sizes which are being stored on the shelf.

From a general point of view, folding shelves with a spring-biased feature are well known in the art. Thus, for example, U.S. Pat. No. 3,677,203 discloses a merchandise support provided with a hinged shelf which rises to a vertical position when the load is removed from the shelf. U.S. Pat. No. 3,137,251 shows merchandise racks wherein, when the merchandise is completely removed, the tension on the coil springs will lift the shelf to a vertical position as shown in FIGS. 1 and 2 of the patent. U.S. Pat. No. 3,631,820 shows a display device wherein a shelf or separator will, by virtue of the flexible spring hinge, arc toward a vertical position on a variable axis when all merchandise is removed from its upper surface. U.S. Pat. Nos. 3,151,576, 3,217,667 and 3,905,310 are cumulative in disclosing spring-biased storage racks or stands.

The prior art also shows trays or racks which are adjustable in the vertical direction. Thus, U.S. Pat. No. 2,908,395 discloses a display rack with folding and vertically adjustable trays. The trays are also spring-biased so that they swing into an upward and vertical direction when merchandise is removed from the tray. U.S. Pat. No. 3,045,831 shows a shelf assembly which is vertically slidable along vertical support members. The rack is also provided with spring-biased shelves which, when unloaded, fold in the upward, out-of-the-way, position. U.S. Pat. No. 3,161,158 also shows a display rack with vertically adjustable shelves.

In connection with the various ways in which the shelf members can be mounted on a vertical member, U.S. Pat. No. 3,907,119 shows a display device which utilizes a vertical column to which flexible shelves are mounted. As noted in this patent, when the mounting bolt 36 is loosened, the transverse mounting bars may be moved vertically, relative to the pedestal 1, and in this manner the display device is rendered readily adjustable for use with displayed items such as bottles which are of varying heights. U.S. Pat. No. 3,616,938 also shows a center channel adjustable display and vending rack wherein a center channel 36 is provided for receiving a vertically sliding body 58 which has attached thereto a spring-biased shelf 50.

Although the general features of the adjustable, folding, springback shelf bracket of the present invention can be found in a number of the prior art patents discussed hereinabove, the prior art does not recognize the unique design of the specific features of the springbiased shelf bracket of the present invention which includes the spring-biased concept wherein the shelf springs back to a vertical position after it has been unloaded; a vertically positioned track which permits ease in mounting of both the track and the shelf to the track to provide for a variable distance between adjacent shelves to accommodate packages of variable height; and a unique design of the vertical track, the shelf bracket and the hinge system which permits the various elements of the spring-biased shelf bracket to be extruded of a material sufficiently flexible to fold about fold lines, as described hereinbelow, rather than injection molded which reduces tooling cost and increases manufacturing speed. In fact, the simplicity of the design and ease of assembly renders the adjustable springbiased shelf bracket of the present invention very cost effective.

Accordingly, an object of the present invention is to provide a spring-biased shelf bracket wherein the shelf support member springs back to a vertical position after it has been unloaded.

Another object of the present invention is to provide a vertically positioned track which permits a springbiased shelf bracket to be mounted thereto to provide for a variable distance between adjacent shelves for accommodating packages of variable height.

A further object of the present invention is to provide a shelf bracket, a hinge system and a vertical track of such unique design and simplicity that the various elements can be extruded rather than injection molded, thereby reducing tooling costs and increasing manufacturing speed.

Other objects and further scope of the applicability of the present invention will become apparent from the detailed description given hereinafter. It should be understood, however, that the detailed description and specific examples, while indicating preferred embodiments of the invetion, are given by way of illustration only, since various changes and modifications within the spirit and scope of the invention will become apparent to those skilled in the art from this detailed description.

The folding, spring-biased shelf bracket of the present invention supports a shelf member. When the shelf is not being used, the bracket folds upon itself in a substantially vertical alignment. The bracket acts as a hinge member about which the shelf member can move from a closed, folded, substantially vertical position to an extended, substantially horizontal position. At least one of the end portions of the bracket is provided with a spring device which, in its relaxed state, holds the shelf in its folded, vertical position. By placing articles on the shelf, the shelf can be forced from its vertical position to a horizontal position against the bias of the spring member. Thus, once the articles are removed from the shelf member, the bias of the spring will return the shelf to its folded, substantially vertical position. A flange member is provided to extend along the middle portion of one side of the bracket to enable the easy mounting of the bracket to a mounting track which in turn can be mounted on a wall or on a piece of display equipment. As will be readily seen by referring to the drawings as discussed hereinbelow, the V-shaped flange can be mounted in the vertical track, the specific design and the overall simplicity of the bracket design, including the fact that it can be extruded rather than injection molded, are all features which contribute both individually and in combination to the improve adjustable spring-biased shelf bracket of the present invention.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
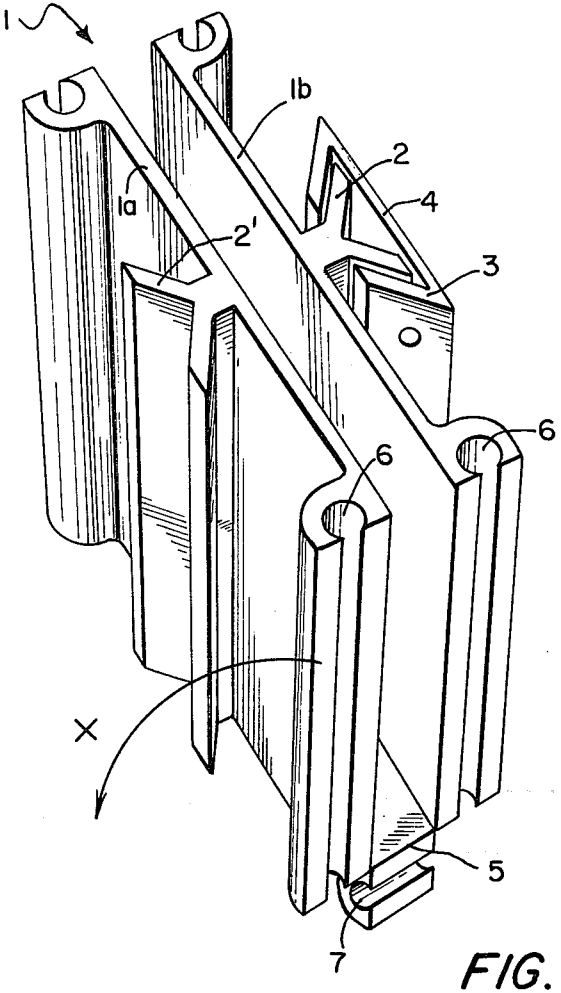
FIG. 1 shows the adjustable spring-biased shelf bracket of the present invention in a folded state and mounted to a track member.

The adjustable, folding, spring-biased shelf bracket of the present invention will now be described in greater detail with particular reference to FIG. 1 which shows the shelf bracket 1 folded upon itself in a vertical, closed position. The bracket includes a shelf support member 1*a* and a back member 1*b*. In use, a shelf member (not shown) is attached to support member 1*a* by conventional fasteners, adhesives, or the like. The bracket 1 is provided along the middle portion of one side thereof with a mounting flange 2 which, as shown in the drawing, has a substantially V-shaped configuration. A vertically disposed track member 3 can be mounted on any suitable surface, such as for example, on a wall or a permanent piece of display equipment. The vertically disposed track member has an internal channel 4 which has a shape which is complimentary to the mounting flange 2 so that the mounting flange can be slidably mounted within the channel 4. Although a portion of the mounting flange identified as 2' is not used in a particular application, such as shown in FIG. 1, as a means for mounting the shelf to the wall, it still serves the function of adding additional rigidity to the bracket and shelf member when it is in its extended position and additionally functions to avoid interference when stacking the elements together for packing.

When disposed in its folded position, the bracket defines a hinge 5 which defines fold lines or pivot axes at the portions thereof which are adjacent members 1*a* and 1*b* about which the shelf member pivots. The hinge 5 can have a variable dimension but advantageously has a width of at least about one-fourth inch so as to provide a one-fourth inch gap between the folded sections of the bracket to allow for corrugations which may be present in the shelf member. The edges of the portions 1*a* 1*b* and the edges of the hinge area are provided with enlarged channels 6 and 7 which are designed and adapted to receive the torsion bar spring member shown in FIG. 2. The spring member is adapted to be snapped into these channels.

Figure 2:
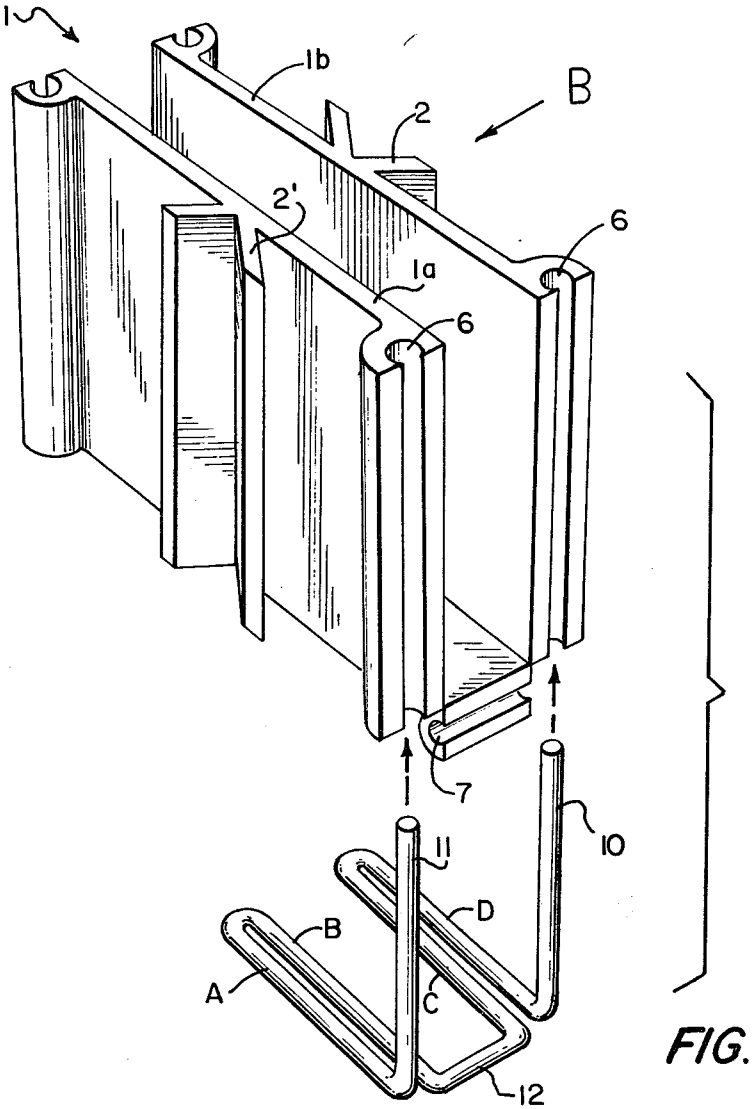
FIG. 2 shows the bracket of FIG. 1 including a spring member and how it cooperates with the edge portion of the bracket to produce the spring-biased shelf bracket of the present invention.

With the bracket in its folded state, the enlarged channels 6 and 7 define a substantially U-shaped configuration and accordingly the torsion bar spring, having such a configuration, can be readily snapped into position within these channels. Thus, when the shelf member of FIGS. 1 and 2 is unfolded in the direction X shown by the arrow to support an associated shelf horizontally, the spring members disposed within the channels 6 and 7 are similarly extended against their own bias. By placing suitable containers on the shelf member it can be maintained in its horizontal supporting position against the bias of the spring members. However, when the containers are removed from the shelf member the bias of the spring members will return the shelf to its folded, substantially vertical position.

Figure 3:
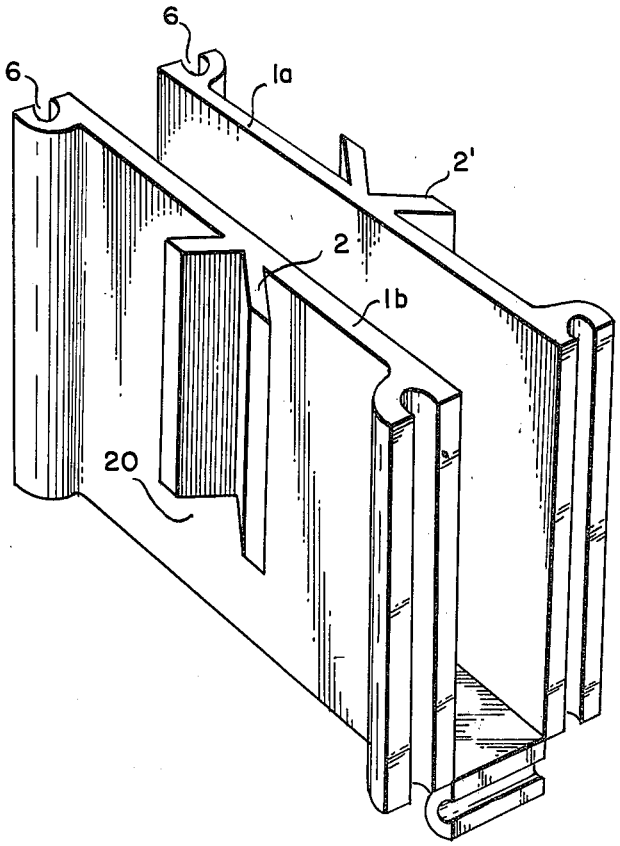
FIG. 3 is a view of the bracket of FIGS. 1 and 2 from the direction of arrow B of FIG. 2.

FIG. 2 is a detailed showing of the spring member utilized in the adjustable folding shelf bracket of the present invention. As shown in FIG. 2, the spring members 10 and 11 are pressed into the channels 6 and spring member 12 is pressed into channel 7. The locking of spring member 12 in channel 7 keeps the spring in place. The spring design is unique insofar as it employs, in its operation, the torsion bar concept. Thus, as the shelf support member is rotated in the direction X, all four members, A, B, C, and D also rotate. This provides a four power multiplier for the torsion arm, while employing a spring that will totally recover when the spring arm members 10 and 11 having been rotated to an angle of 90°. The specific design of the spring member also eliminates the downward extension of the spring from the shelf member. Since the hinge portion D may extend beyond the middle of the shelf and thus beyond the V-shaped mounting flange 2, the mounting flange may be machined away in the vicinity of the hinge 5, as shown at 20 in FIG. 3 to avoid interference with the spring portion D with the shelf in the horizontal position. Also, the pressure of the torsion bar spring D against the vertical track 3 inhibits the vertical movement on the track when the shelf is unloaded.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A spring-biased shelf bracket which comprises:

a back member;

a shelf support member movable relative to said back member;

hinge means for permitting movement of said shelf support member relative to said back member and for maintaining said members in spaced relation to each other;

a mounting flange provided on at least said back member for mounting said bracket to a surface;

channel means provided at peripheral portions of said back member, shelf support member, and said hinge means; and spring means associated with said channel means for biasing said back member, shelf support member and hinge means into first positions relative to each other and for permitting movement of said members and hinge means into at least second positions.

2. A bracket as in claim 1 wherein, in said first positions, said shelf support member is substantially parallel to said back member and, in said second positions, said shelf support member is substantially perpendicular to said back member.

3. A bracket as in claim 1 wherein, in said first positions, said back member, hinge means and shelf support member define a substantially U-shaped configuration.

4. A bracket as in claim 1 or 3 wherein said spring means has a configuration conforming substantially to said channel means and is disposed substantially within said channel means.

5. A bracket as in claim 1 wherein:

said hinge means defines at least one axis for pivotal movement of said shelf support member relative to said back member; and said spring means comprises at least one torsion spring extending substantially parallel to said axis.

6. A bracket as in claim 5 wherein said at least one torsion spring comprises two torsion elements parallel to each other and joined to each other at a first end of each element.

7. A bracket as in claim 6 wherein the opposite end of each torsion element is joined to respective portions of said spring means disposed within said channel means.

8. A bracket as in claim 5 or 6, comprising two of said axes for pivotal movement and two said torsion springs substantially parallel to said respective axes.

9. A bracket as in claim 1 wherein said mounting flange is provided on at least said back member and said shelf support member.

10. A bracket as in claim 1 wherein said mounting flange is adapted to cooperate with a channel associated with said surface for supporting said bracket on the surface.

11. A bracket as in claim 10 wherein said flange is adapted to be slidably received within said channel.

12. A bracket as in claim 1 or 11, wherein said flange is substantially V-shaped.

13. A bracket as in claim 5 wherein a portion of said flange is removed in the vicinity of said at least one axis.

14. A bracket as in claim 1 wherein:

said hinge means defines at least one axis for pivotal movement of said shelf support member relative to said back member; and said channel means comprises channel portions perpendicular to said axis on at least said shelf support member and said back member.

15. A bracket as in claim 14, comprising a channel portion perpendicular to said axis on said hinge means.

16. A bracket as in claim 15 wherein said channel portions lie substantially in a common plane.

17. A bracket as in claim 1 or 16 wherein said shelf support member, back member and hinge means are formed from a unitary extruded element.

* * * * *